US009254072B2

(12) United States Patent
Peguero

(10) Patent No.: US 9,254,072 B2
(45) Date of Patent: Feb. 9, 2016

(54) HYDRAULIC MOTOR CAPABLE OF MANY DIFFERENT APPLICATIONS ABLE TO USE LOW-PRESSURE OR HIGH-PRESSURE FLUIDS TO OPERATE

(71) Applicant: Weldy Peguero, Ridgefield Park, NJ (US)

(72) Inventor: Weldy Peguero, Ridgefield Park, NJ (US)

( * ) Notice: Subject to any disclaimer, the term of this patent is extended or adjusted under 35 U.S.C. 154(b) by 647 days.

(21) Appl. No.: 13/626,950

(22) Filed: Sep. 26, 2012

(65) Prior Publication Data

US 2014/0083287 A1 Mar. 27, 2014

(51) Int. Cl.

| | |
|---|---|
| ***F03C 1/007*** | (2006.01) |
| ***A47L 11/40*** | (2006.01) |
| ***A47L 11/26*** | (2006.01) |
| ***A46B 13/06*** | (2006.01) |
| *D06F 9/00* | (2006.01) |

(52) U.S. Cl.

CPC ..... *A47L 11/4088* (2013.01); *A46B 13/06* (2013.01); *A47L 11/26* (2013.01); *A47L 11/4038* (2013.01); *A47L 11/4069* (2013.01); *F03C 1/0076* (2013.01); *D06F 9/00* (2013.01); *F03C 1/007* (2013.01)

(58) Field of Classification Search

USPC ..... 15/23; 91/218

IPC .... A61C 17/30; F03C 1/00,1/007, 1/013; F01C 21/18

See application file for complete search history.

(56) References Cited

U.S. PATENT DOCUMENTS

| | | | | | |
|---|---|---|---|---|---|
| 2,742,880 | A | * | 4/1956 | Ball | 91/218 |
| 3,909,867 | A | * | 10/1975 | Hogsell | 15/24 |
| 4,155,137 | A | * | 5/1979 | Kadlub | 15/4 |
| 4,370,771 | A | * | 2/1983 | Gonzalvo | 15/29 |
| 4,603,448 | A | * | 8/1986 | Middleton et al. | 15/22.1 |
| 4,720,883 | A | * | 1/1988 | Sanchez | 15/4 |
| 4,768,438 | A | * | 9/1988 | Hughes | 101/363 |
| 4,899,638 | A | * | 2/1990 | Brown | 91/346 |
| 5,146,642 | A | * | 9/1992 | Mank et al. | 15/24 |

* cited by examiner

*Primary Examiner* — Christopher Harmon

(74) *Attorney, Agent, or Firm* — Joshua Kaplan; Kaplan Law Practice LLC

(57) ABSTRACT

A hydraulic motor able to use low-pressure or high-pressure fluids such as water for a large number of applications. The motor uses a flow of water that is controlled and directed through a system of supply tubes to a chamber that fills with the fluid, moving a piston that produces an action such as rotating a shaft to turn a brush. Fluid fills the chamber through a system of opening and closing valves that direct and control the flow of the fluid so that the piston exerts pressure against a spring until it reaches a maximum position. A system of valves then reverses the flow of fluid until the piston is pushed in the opposite direction, producing an action such as turning a brush through the alternating application of water flows. A one-way gear box may be used to control the action of a shaft, which may be directed to turn in the same direction or in alternating directions to accomplish a wide variety of applications such as an hydraulic brush, gearbox speed increaser, generator or washing machine.

7 Claims, 10 Drawing Sheets

HYDRAULIC MOTOR CAPABLE OF MANY DIFFERENT APPLICATIONS ABLE TO USE LOW-PRESSURE OR HIGH-PRESSURE FLUIDS TO OPERATE

FIELD OF THE INVENTION

The present invention relates to the field of fluid-powered hydraulic motors. More particularly, this invention relates to hydraulic motors operating on low-pressure or high-pressure water or other fluids and is useful for many different applications such as cleaning various objects and surfaces using water pressure to power a hydraulic brush using alternating flows of water.

BACKGROUND OF THE INVENTION

The use of water pressure powered hydraulic motors is well known. These types of devices are found in such items as clothes washing machines, car washes, robot floor cleaners and toothbrushes. These all utilize turbines, wheels driven by water power which may use the power generated to move brushes.

Many types of hydraulic motors are available, using all manner of construction and materials. These suffer, however, from a number of disadvantages such as being too complicated or difficult to use. Moreover, the turbine system is inefficient. Devices such as those disclosed by certain patents use simple turbine systems, such as U.S. Pat. No. 8,051,527 which discloses a cleaning robot system that can perform wet washing; U.S. Pat. No. 7,631,386 which discloses a hand-held cleaning apparatus for cleaning carpets and other surfaces with a motorized cleaning head; U.S. Pat. No. 7,302,734 which discloses a self-propelled ground cleaning machine with hydraulically driven rotating brush; U.S. Pat. No. 6,689,078 which discloses a self-contained oral cleaning device in which tap water from the faucet is pressurized to activate variously shaped interchangeable heads with bristles: U.S. Pat. No. 6,213,964 which discloses a hydro-mechanical massaging apparatus with a component that effects massage with water and a turbine, U.S. Pat. No. 4,660,244 which discloses a hydraulic brush for teeth and gums which includes a rotating brush; U.S. Pat. No. 4,441,226 which discloses a car washing apparatus having a rotary brush; and U.S. Pat. No. 4,163,302 which discloses a wall cleaning apparatus with a hydraulically-controlled telescoping boom.

An improved hydraulic motor is needed which operates using low-pressure or high-pressure fluids such as water, and is useful for such applications as cleaning objects and surfaces using water pressure to power a hydraulic brush in a more efficient way.

SUMMARY OF THE INVENTION

It is therefore an object of the present invention to provide a hydraulic motor capable of using high-pressure or low-pressure fluids such as water, wherein the power of water pressure is applied to effectuate a number of different applications such as rotating a brush using a mechanism that produces alternating flows of water.

It is a further object of the present invention to provide an apparatus wherein water from a conventional faucet or tap is carried through flexible tubing to an hydraulic actuator which alternates the flow of water through the device using a system of valves which open and close, which flow of water causes a brush to rotate.

It is a further object of the present invention to provide an apparatus wherein a supply of water is carried to an hydraulic rotary actuator wherein a system of opening and closing valves causes water flow to alternate between two available paths, causing alternating hydraulic pressure which may be applied for cleaning as well as a variety of other uses.

These and other features of the invention can be further understood by reference to the following drawings.

Figure 1:
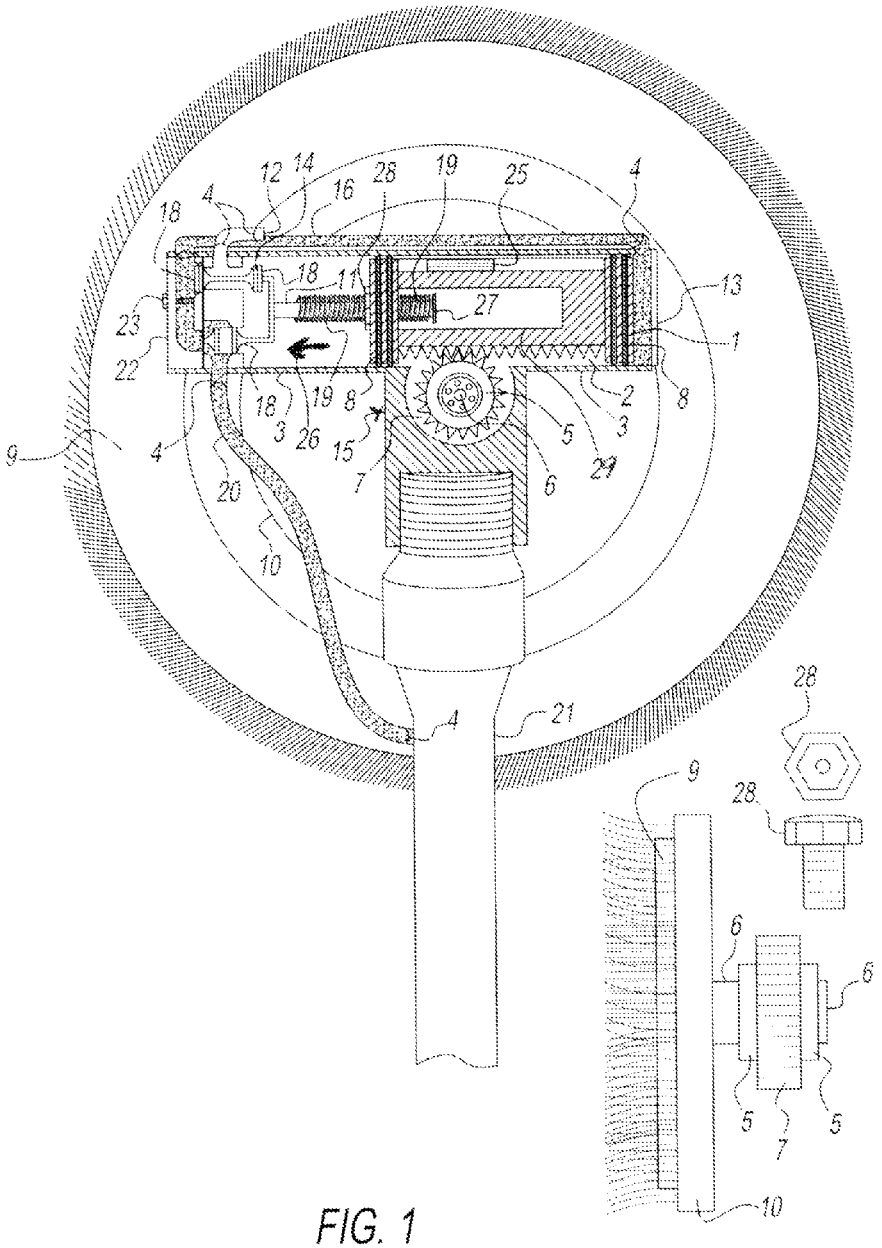
FIG. 1 shows a bottom schematic view of the hydraulic motor according to an embodiment of the present mention that will rotate a brush.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

DETAILED DESCRIPTION OF THE PREFERRED EMBODIMENT

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Now referring to the drawings, FIG. 1 shows the hydraulic motor 21 of the present invention. Water under ordinary tap pressure is admitted through a port 4 to entry line 20 and through second port 4 to integrating valve 22. Water is then admitted through valve 18 into a chamber inside cylinder 3. Water then fills the chamber inside cylinder 3, which puts pressure upon and compresses spring 19. The piston 1 is pushed to the right by the pressure of water filling the chamber inside of cylinder 3, teeth inside the gear rack 2 engage with teeth arranged along the outside of gear 7, turning said gear 7. Rotation of gear 7 turns shaft 6 which is removably attached to brush 9, thus rotating brush 9.

Piston 1 moves to the right until the pressure of water is balanced by the tension on the spring 19. At this point Spring 19 pushes the valve trigger 11, which opens valve 22. This causes water to fill the right side of the chamber inside cylinder 3. Water pressure in the chamber inside cylinder 3 pushes piston 1 to the left, putting pressure on spring 19 and causing the engaged teeth of gear 7 to turn in the opposite direction, causing shaft 6 and brush 9 to rotate until the piston 1 reaches the point where water pressure is balanced by the tension put on spring 19. At this point, valve 22 opens and the other valve closes, causing the left side of the chamber inside cylinder 3 to begin filling with water again, starting the sequence over again. This sequence repeats until the user stops the flow of water into the system.

The foregoing figures may be further understood by reference to the following list of parts shown by name and reference number:

| | |
|---|---|
| Piston | 1 |
| Gear Rack | 2 |
| Cylinder | 3 |
| Port | 4 |
| Bearing | 5 |
| Shaft | 6 |
| Gear | 7 |
| Piston Seal | 8 |
| Cover Brush | 9 |
| Brush | 10 |
| Valve Trigger | 11 |
| Valve Exit Line | 12 |
| End Cap | 13 |
| Plug Seals | 14 |
| Hydraulic Rotary Actuator | 15 |
| Water Line to Cylinder | 16 |
| Connector | 17 |
| Valve Plug | 18 |
| Spring | 19 |
| Entry Line to Valve | 20 |
| Extension Pipe | 21 |
| Integrating Valve | 22 |
| Valve Connection Screw | 23 |
| Soap Dispenser | 24 |
| Support for Piston | 25 |
| Direction of Piston | 26 |
| Retaining Screw for Spring | 27 |
| Bolt with hole in center to accommodate piston trigger | 28 |
| Hollow chamber for Valve trigger | 29 |

Figure 2:
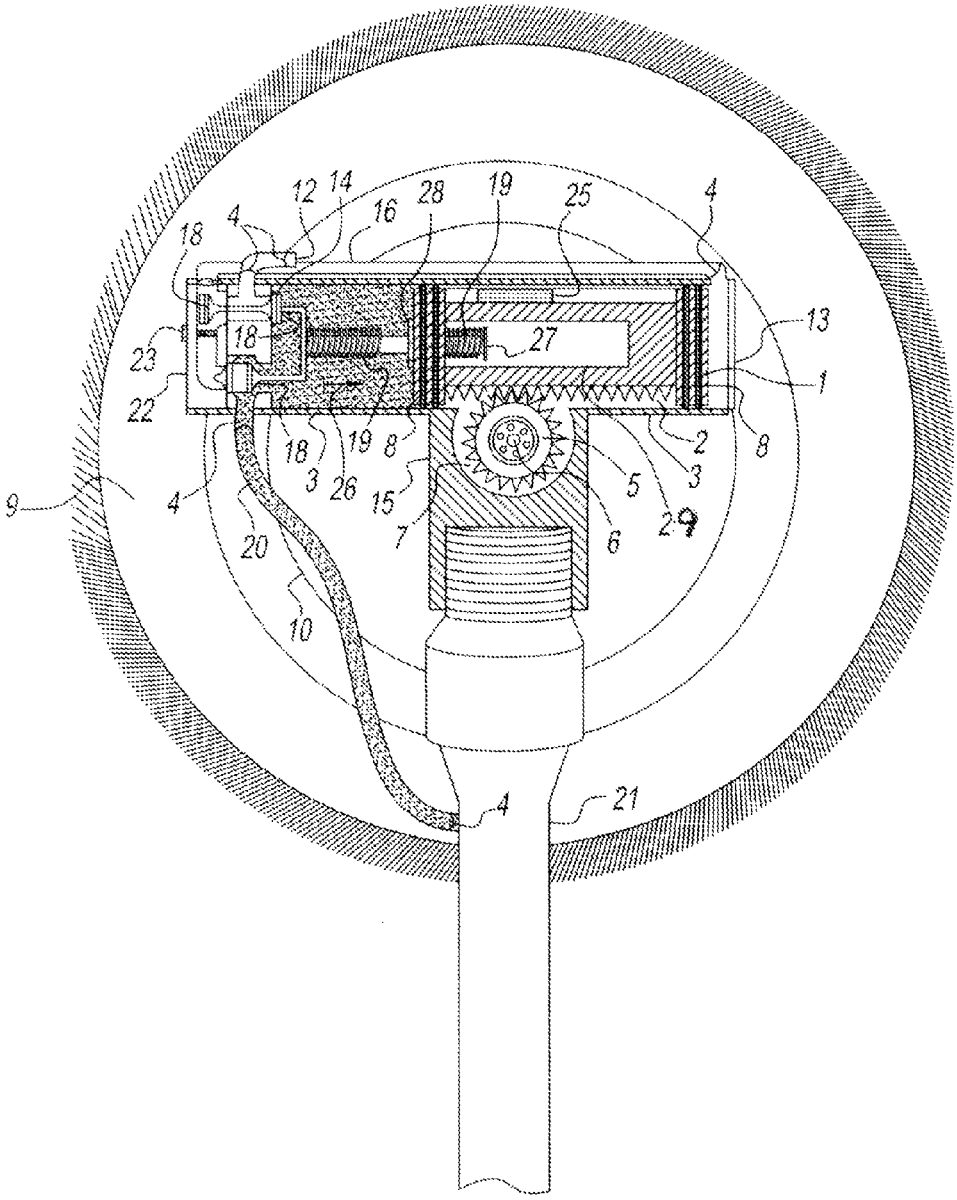
FIG. 2 shows a bottom schematic view of the hydraulic motor according to an embodiment of the present invention that will rotate a brush.

FIG. 2 shows the further progression of fluid through the hydraulic motor, causing movement of fluid filling the left chamber of cylinder 3, pushing the piston 1 in the direction shown by the arrow 26, to the right.

Figure 3:
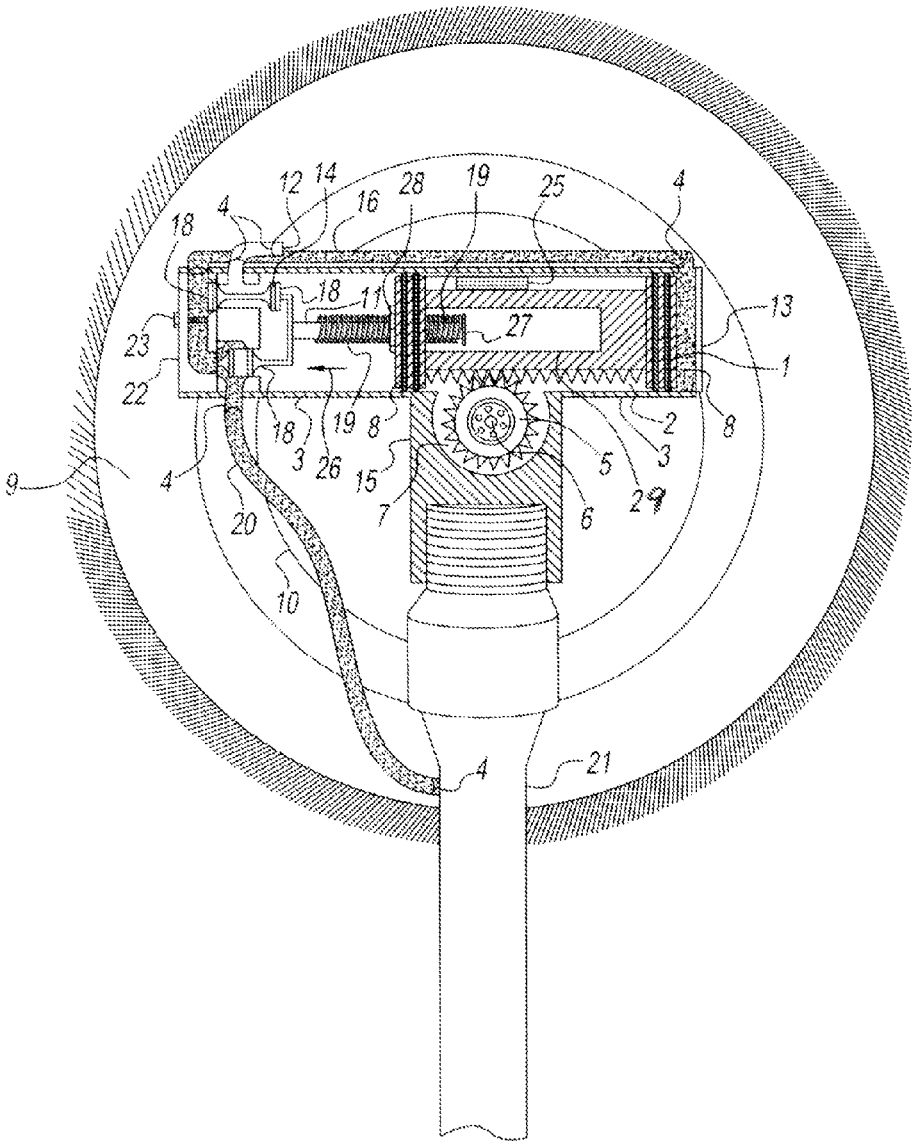
FIG. 3 shows a bottom schematic view of the hydraulic motor according to an embodiment of the present invention that will rotate a brush.

FIG. 3 shows the further progression of fluid through the hydraulic motor, filling the right side of the chamber of cylinder 3, pushing piston 1 in the direction shown by the arrow 26, to the left.

Figure 4:
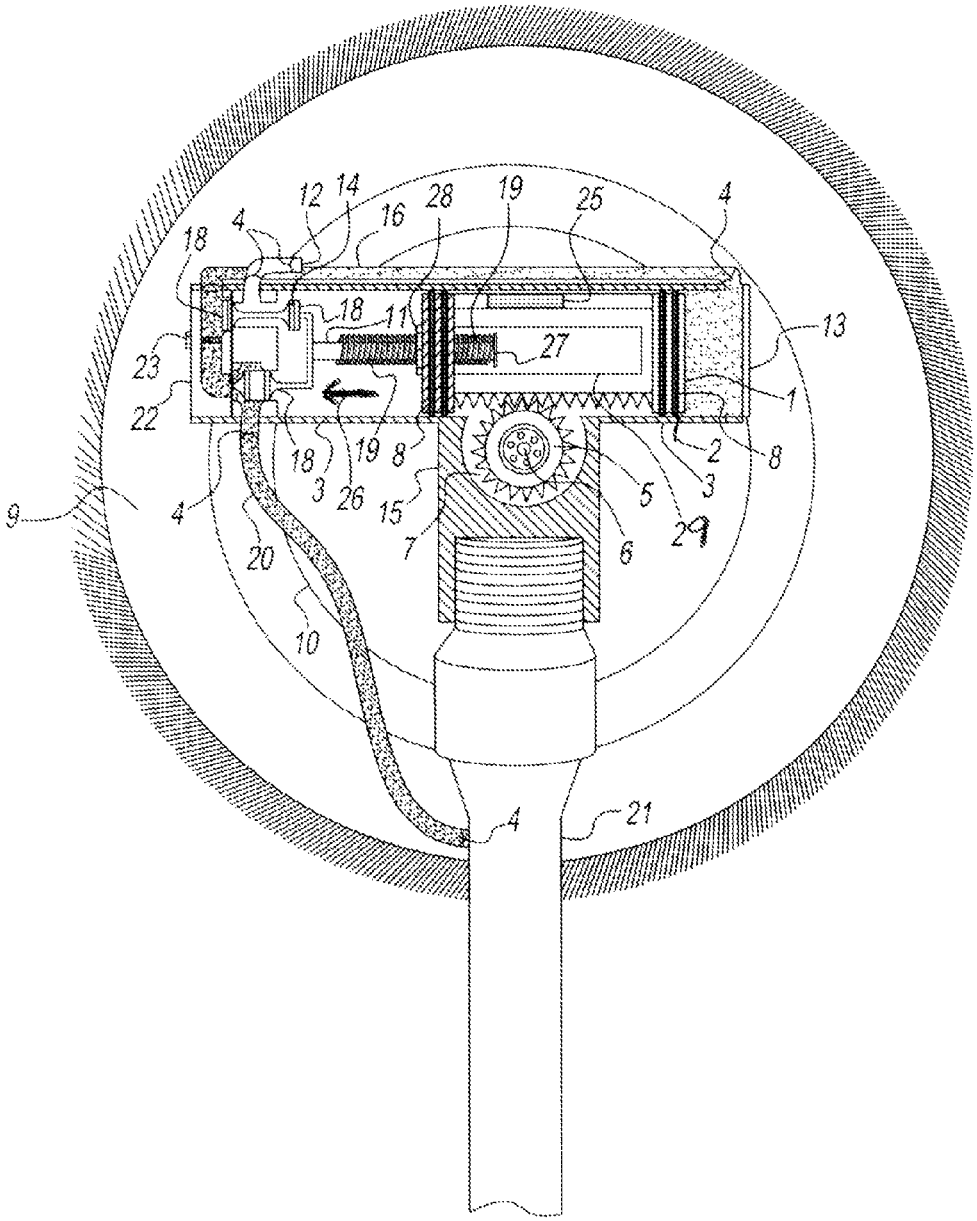
FIG. 4 shows a bottom schematic view of the hydraulic motor according to an embodiment of the present invention that will rotate a brush.

FIG. 4 shows the further progression of fluid through the hydraulic motor, further filling the right side of the chamber of cylinder 3, pushing piston 1 in the direction shown by the arrow 26, to the left.

Figure 5:
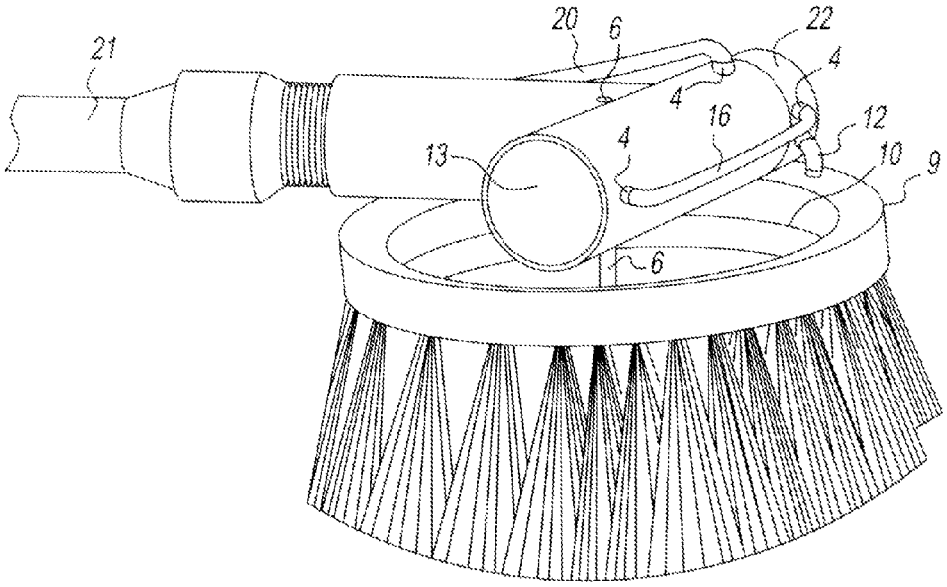
FIG. 5 shows an elevated schematic view of the brush rotated by the hydraulic motor, from the side according to an embodiment of the present invention that will rotate said brush.

FIG. 5 shows the exterior parts of the hydraulic motor, illustrating the port 4, the shaft 6, the cover brush 9, the brush 10, the valve exit line 12, the end cap 13, the water line to the cylinder 16, the entry line to valve 20, the extension pipe 21 and the integrating valve 22.

Figure 6:
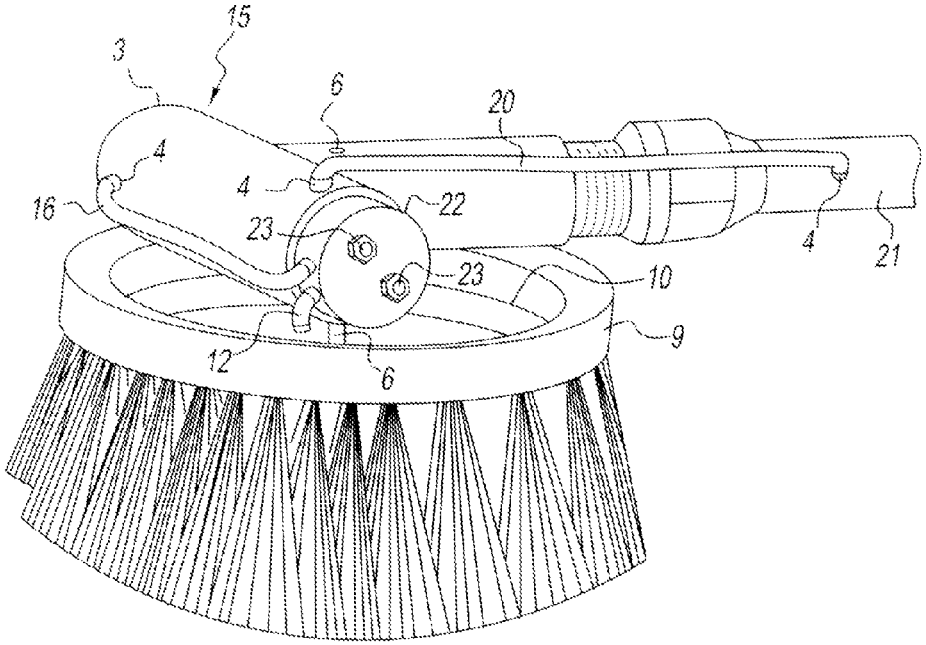
FIG. 6 shows an elevated schematic view of the brush rotated by the hydraulic motor, from the other side according to an embodiment of the present invention that will rotate said brush.

FIG. 6 shows the exterior parts of the hydraulic motor from the other side illustrating the cylinder 3, the port 4, the shaft 6, the cover brush 9, the brush 10, the valve exit line 12. the hydraulic rotary actuator 15, the water line to the cylinder 16, the entry line to valve 20, the extension pipe 21, the integrating valve 22 and the valve connection screws 23.

Figure 7:
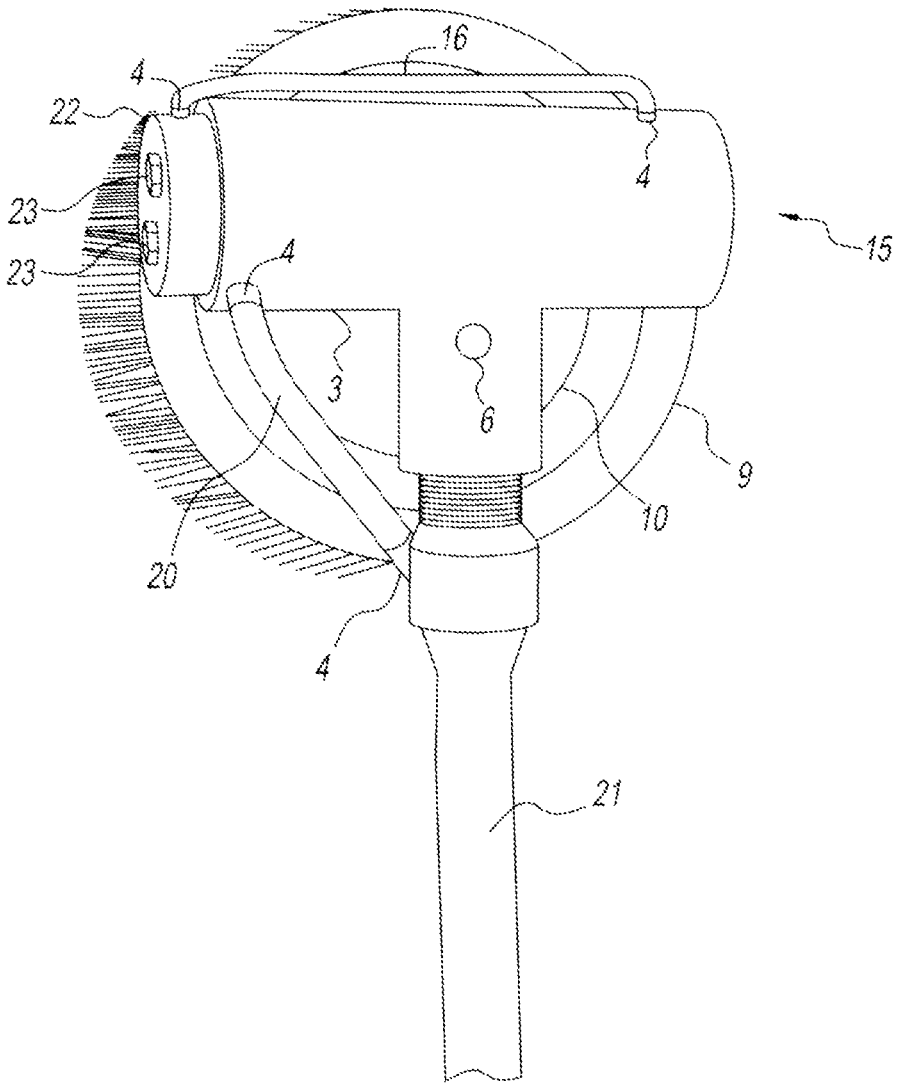
FIG. 7 shows an elevated schematic view of the top of the hydraulic motor according to an embodiment of the present invention that will rotate a brush.

FIG. 7 shows the exterior parts of the hydraulic motor from the top, illustrating the cylinder 3, the port 4, the shaft 6, the cover brush 9, the brush 10, the hydraulic rotary actuator 15, the water line to the cylinder 16, the entry line to valve 20, the extension pipe 21, the integrating valve 22 and the valve connection screws 23.

Figure 8:
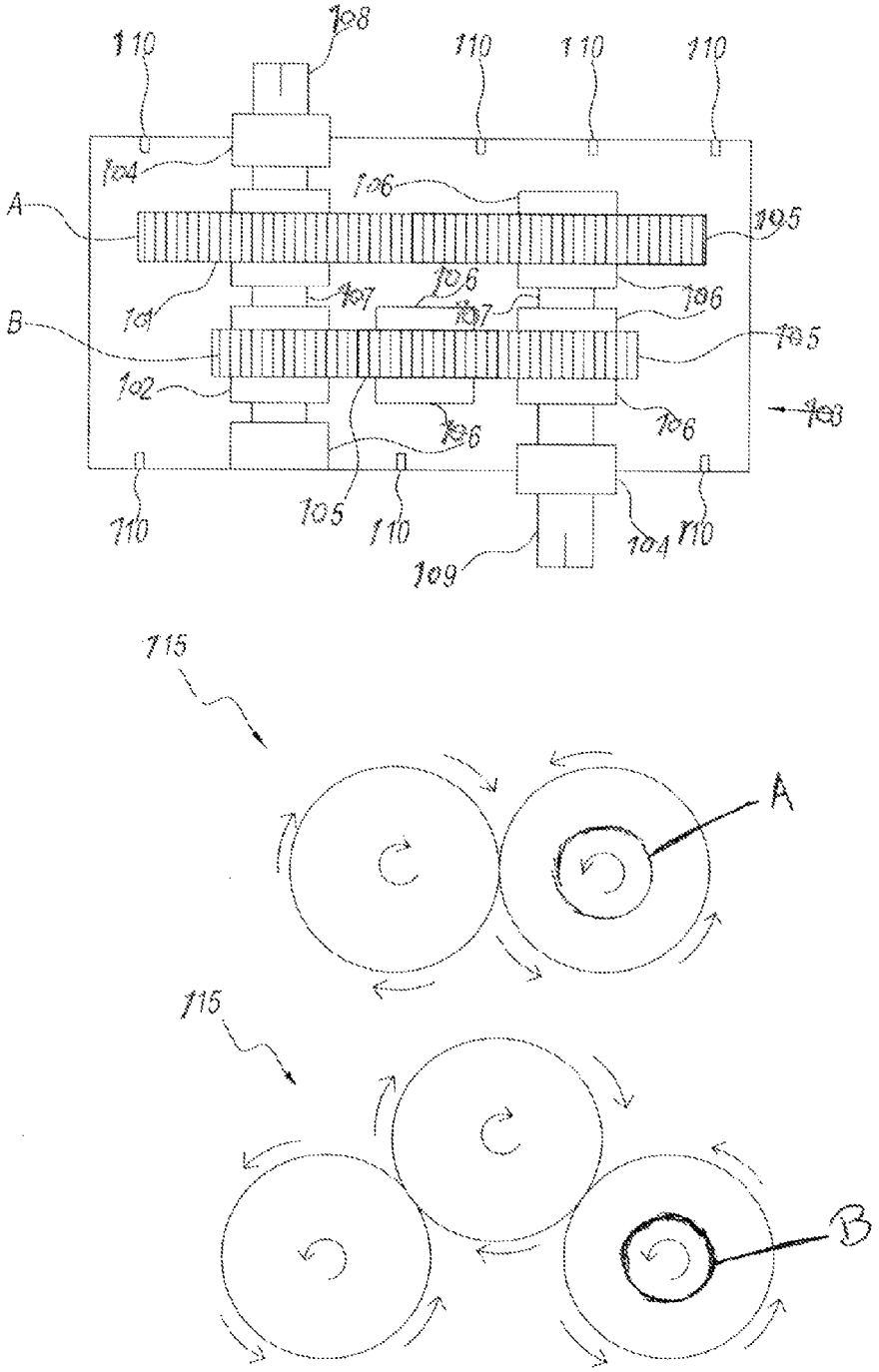
FIG. 8 shows an elevated schematic view of the side of a one-way gear box. which may be attached to the hydraulic rotary actuator of the hydraulic motor of the present invention to convert the alternating flow of water, which causes an alternating rotation of a shaft, to a one-way continuous rotation, producing an embodiment of the present invention suitable for many different applications.

FIG. 8 shows a one-way gearbox, which may be attached to the hydraulic motor of the present invention to the shaft 1 shown in FIG. 1. The one-way gearbox will allow the shaft to rotate in only one direction, enabling the present invention to be applied to a wide variety of applications. A one-way gear or gear clutch 101 is mounted on the shaft, and will clutch when motion goes to the right. A second one-way gear or gear clutch 102 is mounted on the shaft and will clutch when motion goes to the left. The body 103 of the one-way gearbox contains the gears, the shaft and the bearings. The bearing 104 will reduce friction and prevent oil from leaking from the one-way gearbox. The gear 105 is attached to the shaft. The bearing 106 is mounted on the shaft to reduce friction. The gear 105 and the hearing 106 are mounted on the shaft 107. A shaft 108 connects to the hydraulic rotary actuator 15 shown in FIG. 1. A shaft 109 connects to a variety of other embodiments including a gearbox speed increaser, generator, washing machine or a variety of other applications. The body of the gear box 103 is attached to the hydraulic rotary actuator 15 shown in FIG. 1 at seven connection points 110.

The action of the one-way gear box is described in FIG. 8 by the clutch A which controls two gears, and will allow the first gear 107 and second gear 106 to rotate to the right or to the left, but will clutch when it goes right, releasing the shaft. Clutch B controls three gears; the first gear 102 may rotate to the left or to the right, the second gear 105 may rotate to the left or to the right and the third gear 106 may rotate to the left or to the right, but will clutch when it goes to the left, releasing the shaft.

Figure 9:
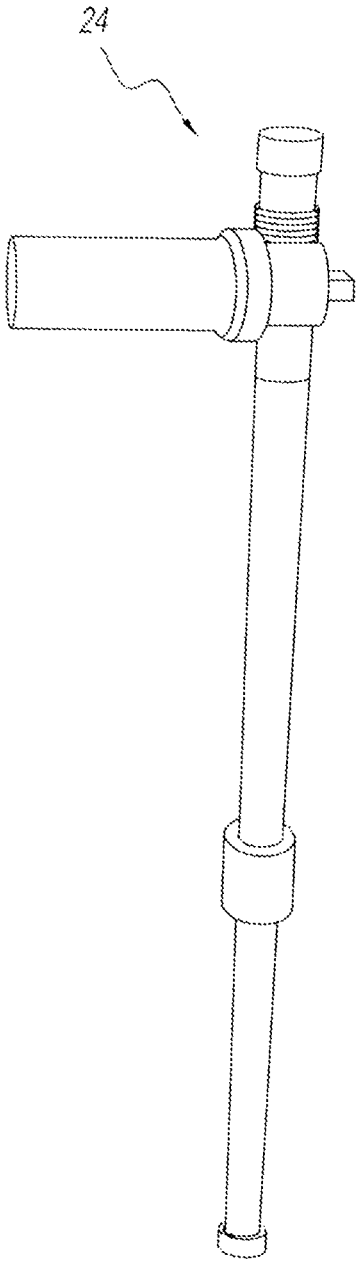
FIG. 9 shows an elevated schematic view of the side of the handle and soap dispenser of the hydraulic motor according to an embodiment of the present invention which will rotate a brush.

FIG. 9 shows the extension pipe 21.

Figure 10:
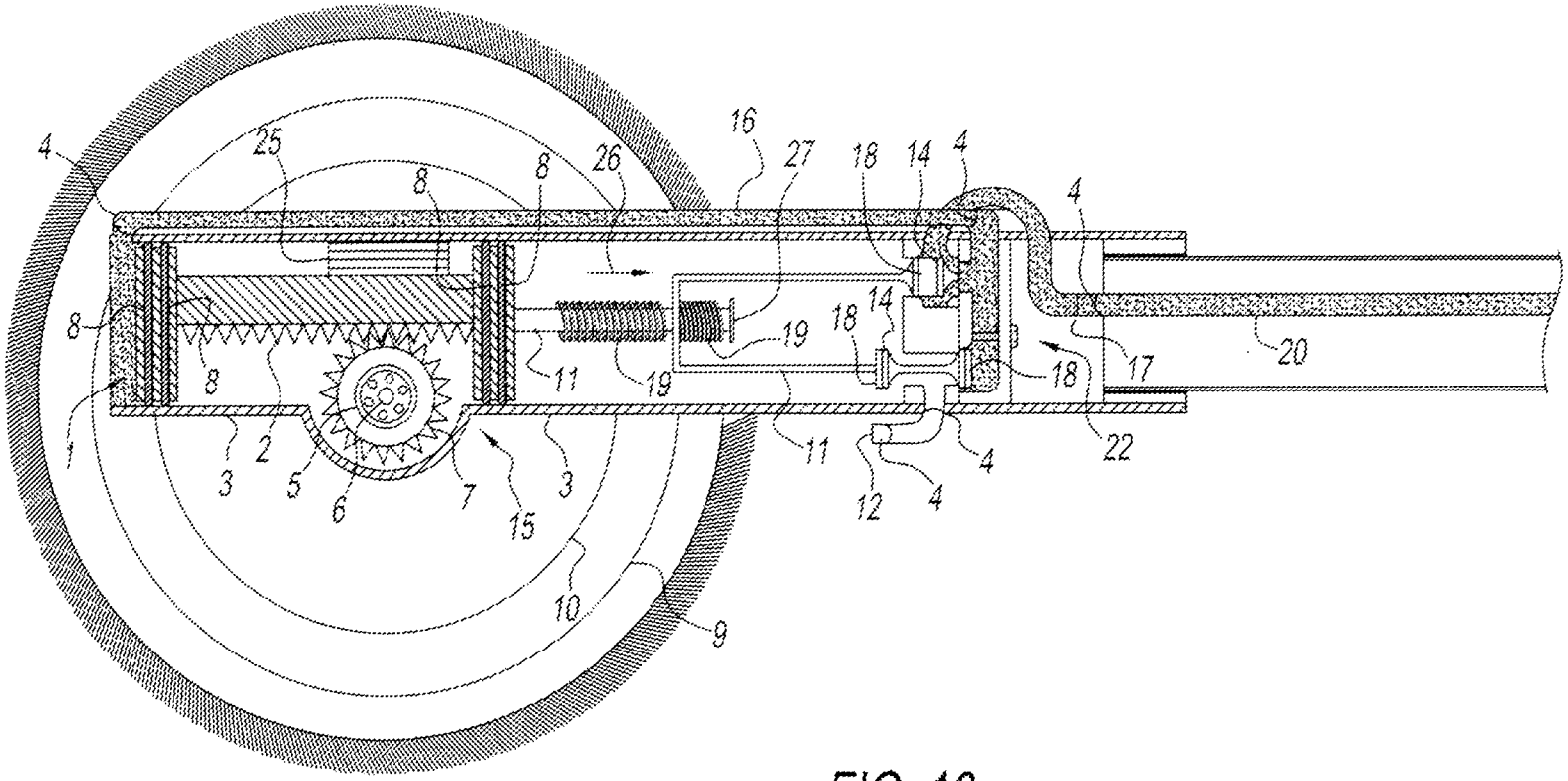
FIG. 10 shows a bottom schematic view of the hydraulic motor according to an alternate embodiment of the present invention, using a different arrangement of parts to rotate a brush.

FIG. 10 shows the progression of fluid through another embodiment of the hydraulic motor using the same parts in a slightly different arrangement, with the fluid filling the entry line to valve 20, the water line to cylinder 16, through port 4, causing movement of fluid filling the left chamber of cylinder 3, pushing the piston 1 in the direction shown by the arrow 26, to the right.

What is claimed is:

1. A hydraulic motor enabled through introduction of pressurized fluids comprising:

a body having a left side and a right side defining a horizontal axis for said body and a front end and a rear end defining a longitudinal axis for said body, perpendicular to said horizontal axis, said body containing a cylinder capable of holding a fluid;

said cylinder internally having a piston comprising of two piston crowns aligned in parallel to each other and perpendicular to a wall of said cylinder; wherein said piston crowns separated by a gear rack, each said piston crown mounted one to each end of said near rack;

said gear rack having teeth on one side of said gear rack, said teeth meshing with a gear wherein said gear surrounding a shaft running through said gear's center and perpendicularly therethrough and being rotated by rotation of said gear;

a valve trigger with a first end connecting to a bridge between two inlet outlet valve plugs and with a second end having a retaining screw, said valve trigger disposed through a center bolt hole in one of said piston crowns and running substantially perpendicular to an axis of said piston crown; wherein said valve trigger is slidably reciprocating within with said bolt hole;

a spring divided into a first section and a second section encasing said valve trigger;

wherein a first section encasing said valve trigger on a first side of said one of said piston crowns, said first section disposed between said bridge against its first end and said crown of said piston against its second end, and a second section encasing said valve trigger, with a first end against said piston crown and with a second end of said spring against said retaining screw; wherein said gear rack connecting to said one of said piston crowns further comprises a cavity to permit insertion and retraction of said valve trigger reciprocating through said bolt hole;

said bridge having a top valve to drain said left side of said cylinder of a moderately pressurized fluid into an exit line, and said bridge having a lower valve to intake said pressurized fluid into said left side or so direct said pressurized fluid through a water line to said right side of said cylinder;

an entry line originating at a source of said moderately pressurized fluid terminating at said water line inside said cylinder;

said moderately pressurized fluid being transported through said entry line, from said source to the interior of a rotary actuator cylinder, through a five way double pilot valve said five way double pilot valve comprised of said bridge separating said top valve and said bottom valve and said moderately pressurized fluid exerting pressure on a piston which moves to the side, rotating a shaft capable of rotating an attachment disposed on and end of said shaft opposing to an end being surrounded by said gear wherein said pressurized fluid exerting pressure on a spring being retained by said bridge until said first section is substantially compressed and the piston can no longer move toward said left side, at which point said right side is filled with said pressurized fluid, where said top valve having been pushed by said bridge sufficiently laterally to close said exit valve and said bottom valve having been pushed by said bridge sufficiently laterally to close said water line to said right side and open a port into said left side causing said piston to moving in opposite direction from a first motion, causing said second section to become fully compressed against said retaining screw, wherein said piston cannot move in the given direction any further, at which point the pressure of said second segment exceeds the pressure of said fluid inside said left side, causing said piston to move in opposing direction;

wherein said gear rack reciprocating with said cylinder causing said gear to rotate;

and wherein said gear causing said shaft to rotate;

and wherein said shaft and said gear forming a rotary actuator having an end within said gear and an opposing end connecting to an attachment being oscillatingly enabled by said rotatory actuator.

2. The hydraulic motor of claim 1, wherein the moderately pressurized fluid supplied is tap water.

3. The hydraulic motor of claim 1, wherein the fluid supplied is low-pressure water.

4. The hydraulic motor of claim 1, wherein said rotary actuator is attached to a one-way gear box, converting the alternating rotation of said shaft to one-way continuous rotation.

5. The hydraulic motor of claim 1, wherein said attachment is a the rotating brush.

6. They hydraulic motor of claim 4, wherein said attachment is an electrical generator.

7. The hydraulic motor of claim 4; wherein said attachment is a washing machine.

* * * * *